United States Patent [19]

Shepherd

[11] Patent Number: 4,602,391

[45] Date of Patent: Jul. 29, 1986

[54] DYNAMICALLY BALANCED SUCTION RELIEF FOR HYDROTHERAPY TUBS AND SPAS

[75] Inventor: Philip E. Shepherd, Edina, Minn.

[73] Assignee: Pearl Baths Inc., Minneapolis, Minn.

[21] Appl. No.: 788,499

[22] Filed: Oct. 17, 1985

[51] Int. Cl.[4] ..... A61H 33/02

[52] U.S. Cl. ..... 4/542; 4/541; 4/492; 4/504; 4/544; 128/66; 239/428.5

[58] Field of Search ..... 4/541, 542, 492, 507, 4/491, 504, 543–544; 128/66; 239/428.5–587, 429, 416.5, 413, 416, 416.4

[56] References Cited

U.S. PATENT DOCUMENTS

| | | | |
|---|---|---|---|
| 3,159,849 | 12/1964 | Jacuzzi | 4/542 |
| 3,378,858 | 4/1968 | Jacuzzi | 4/507 |
| 3,420,226 | 1/1969 | Berry, Sr. | 4/544 X |
| 3,474,469 | 10/1969 | Steltz | 4/544 |
| 3,890,656 | 6/1975 | Mathis | 4/542 |
| 3,940,807 | 3/1976 | Baker et al. | 4/490 |
| 3,946,449 | 3/1976 | Mathis | 4/542 |
| 3,986,217 | 10/1976 | Doerr | 4/542 |
| 4,115,878 | 9/1978 | Johnson et al. | 4/492 |
| 4,359,790 | 11/1982 | Chalberg | 4/541 |
| 4,402,094 | 9/1983 | Sander | 4/541 X |

*Primary Examiner*—Henry K. Artis

*Attorney, Agent, or Firm*—James V. Harmon

[57] ABSTRACT

A dynamically balanced suction relief is provided for a hydrotherapy tub or spa in which a controlled amount of water under pressure is supplied from the water pump to an air inlet duct to maintain a column of water in the air duct under normal conditions.

8 Claims, 5 Drawing Figures

DYNAMICALLY BALANCED SUCTION RELIEF FOR HYDROTHERAPY TUBS AND SPAS

FIELD OF THE INVENTION

The present invention relates to spas and hydrotherapy tubs and more particularly to an apparatus for preventing excessive suction when the tub outlet becomes obstructed.

BACKGROUND OF THE INVENTION

U.S. Pat. No. 4,115,878 describes a method for admitting air into the water outlet, i.e., suction line of a spa, to prevent excessive suction when the outlet becomes blocked. The patented system may operate satisfactorily in a hot tub or spa which is relatively deep, e.g., filled with water to a depth of 29–48 inches. However, the present invention is concerned primarily with drain-and-fill tubs which are filled to an average depth of only about 15–17 inches. When an attempt is made to use the patented system in a drain-and-fill tub of the kind with which the present invention is concerned, the system has a tendency to become unstable, for example, water bounces up and down in the vent tube under dynamic conditions of operation. When this happens air is sucked into the pump. This, of course, interferes with the proper operation of the pump because of the air passing through it.

In view of these and other deficiencies of the prior art, it is the primary object of the invention to provide a dynamically balanced system for preventing dangerous and excessive suction at the suction fitting in the spa, tub, or pool by allowing air to enter the pump when the suction fitting is plugged but at the same time preventing air from entering the pump when the suction fitting is not plugged.

It is important to provide an adequate supply of air when the suction fitting does become plugged so, for example, a person will not be injured if one's hand or other part of the body covers the suction outlet of the tub. Another object is to achieve these results without use of moving parts such as mechanically or electrically operated valves and accompanying electrical circuitry such as a vacuum switch. Still, another object is to provide a dynamic balance that will automatically slow down the flow of water whenever a person using the tub obstructs the suction fitting but which at other times pumps water through the outlet at or near maximum efficiency. A further object is to provide an automatic method of dynamic control which is self-regulating so that a greater compensating effect is provided when the output of the pump is increased if a longer pump is used. Yet another more specific object of the invention to provide a relief system as described which operates quickly and gently and in addition begins to function gradually as the object is brought into proximity with the suction fitting so that a person is not hurt by placing a hand over the suction fitting.

It has also been previously proposed to employ a vacuum operated electrical switch to turn off the pump motor when suction becomes excessive. This system is unsatisfactory since it is sensitive to water impurities such as lint or scum and therefore, may fail under dangerous circumstances.

In view of these and other deficiencies in the prior art, the invention will now be described by way of example with reference to the specification and the accompanying figures.

THE FIGURES

SUMMARY OF THE INVENTION

The present invention provides a suction relief for a tub, spa, or pool having a hydrotherapy system with a water inlet and a water outlet connected to each other by means of a water circulation line in which a power operated pump is provided. An air inlet duct is connected on the inlet side of the pump and is open to the atmosphere at its upper end for relieving suction if the tub outlet is obstructed. A water-up make means is associated with the air duct to force make up water thereinto under pressure from the water circulation line. The water make-up means can comprise a pipe connecting the pump outlet to the air inlet duct or in the alternative it can comprise a scoop at the lower end of the near inlet duct directed upstream to collect a portion of the water flowing past it to thereby prevent the water from being withdrawn from the air inlet duct under normal conditions.

DESCRIPTION OF THE PREFERRED EMBODIMENTS

Figure 1:
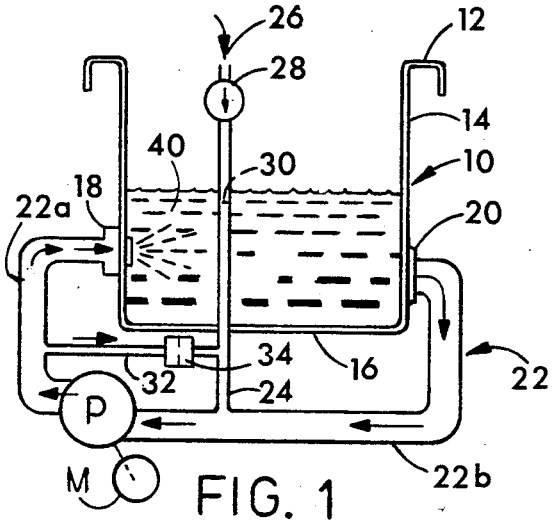
FIG. 1 is a schematic diagram showing one form of the invention as applied to a drain-and-fill tub having a single inlet on suction fitting and a single outlet.

Shown in FIG. 1 is a drain-and-fill tub 10 having a rim 12 sidewall 14 and bottom wall 16. While the invention can be applied to any tub, spa, or pool, it is especially useful in connection with a tub of the kind which is drained and refilled each time it is used. On one side of the tub is a water inlet 18 such as a hydrotherapy jet and on the other side is a water outlet 20. The water inlet and outlet are connected together by means of the water circulation line 22 which includes a pressure line **22*a* and a suction line 22*b*** on opposite sides of a water circulation pump P which is driven during operation by means of a motor M.

Connected to the water inlet or suction line **22*b* is a air inlet duct 24 having an upper normally open inlet opening 26 which communicates with the atmosphere allowing air to enter the system at times as will be described below. A check valve 28 is provided at the upper end of the air inlet duct which allows air to enter but prevents water from escaping in the event water rises to the level of the check valve. The check valve 28 can comprise a floating ball check valve such as a lightweight hollow ball that will move to a seated position sealing the duct in the event it is floated upwardly by the column of water 30 in the duct 24**.

Connected between the pressure line **22*a* and the duct 24 is a make up water pipe 32 which supplies a small amount of water at all times to the air duct 24. If desired, the pipe 32 can be provided with a metering oriface 34 to assure a relatively constant flow of water to the air duct 24 regardless of the pressure within line 22***a*. The metering oriface 34 is not essential. The same effect can be obtained by using a 3 foot long plastic water make-up pipe 32 of small diameter, for example an I.D. of ¾ inches.

During operation, with the pump P drawing water through the suction line 22*b* from the suction fitting 20 and forcing it through the pressure line 22*a* through the hydrotherapy jet 18, a portion of the water under pressure in line 22*a* will be forced toward the right in pipe 32 into the air inlet duct 30 thereby maintaining water level 30 therein substantially equal to the water 40 in tub 10. However when the outlet 20 becomes plugged, the water level 30 will drop in the duct 24 allowing air to enter the line 22*b* causing the pump to cavitate thereby preventing excessive suction at the water outlet 20. When the outlet 20 is not obstructed, the flow of water through pipe 32 will keep the water level 30 in duct 24 high enough so that no air enters the pump P.

Figure 2:
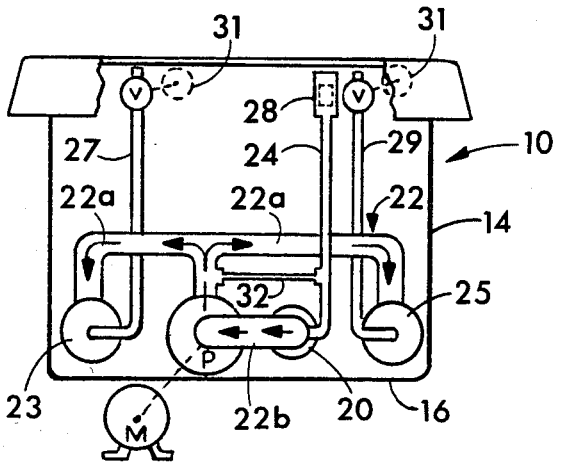
FIG. 2 is another embodiment of the invention as applied to a drain-and-fill tub with a single suction fitting which feeds through a pump to a pair of hydrotherapy jets.

Refer now to FIG. 2 which illustrates a similar drain-and-fill tub 10 having a similar water circulation system including the water circulation line 22 composed of a pressure line 22*a*, a portion of which is connected to a hydrotherapy jet 23 and another portion of which is connected to hydrotherapy jet 25. A water suction line 22*b* is connected to water outlet 20 of the tub 10. As described above the pump P is operated by a motor M.

Corresponding parts in this embodiment are similar to those already described in FIG. 1. In this case, air inlet lines 27 and 29, respectively are connected to the hydrotherapy jets 23 and 25 to allow water to enter the jets under normal operating circumstances. The amount of water entering can be controlled by the valve V at the upper end of each of the air lines 27 and 29 and each of the valves V is operated by means of a handle 31 within the tub to control the amount of air in each water jet and consequently the amount of jet pressure sensed by the user. As in the embodiment of FIG. 1, the make-up water pipe 32 is connected between the pressure line 22*a*and the air inlet duct 24. The pipe 32 can be thought of as compensation pipe for normally maintaining a column of water in the air pipe 24. It thus functions as a make up means associated with the air inlet duct 24 for introducing water thereinto under pressure from the water circulation line 22.

Figure 3:
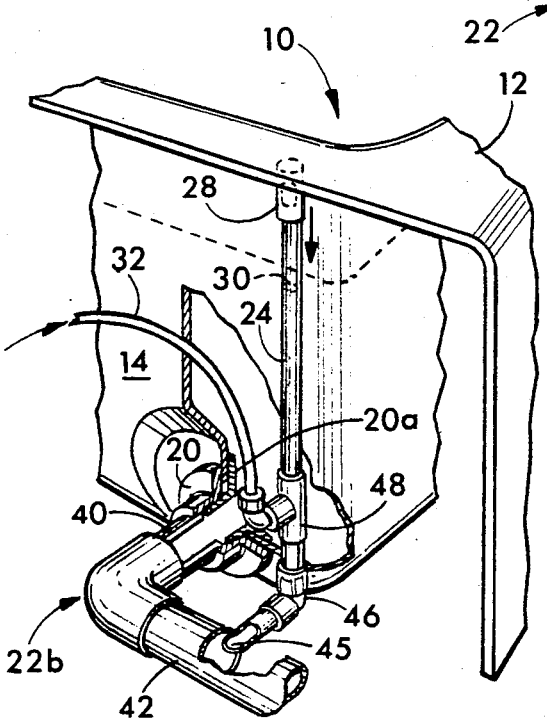
FIG. 3 is the perspective view of the water outlet, i.e. suction line and associated components.

In FIG. 3 which illustrates a typical application of the invention, the water outlet 20 comprises a water outlet fitting which is connected to the wall 14 of the tub 10 by means of a threaded flange 20*a*. The suction line 22*b* is composed of pipe sections 40 and 42 connected together by an elbow 44. Pipe 24 communicates with pipe 42 at 45 which is composed of a horizontal section of pipe connected to the upright portion of the air inlet duct 24 by means of an elbow 46. The water make up pipe 32 is connected to the air inlet duct 24 by means of a T fitting 48.

Figure 5:
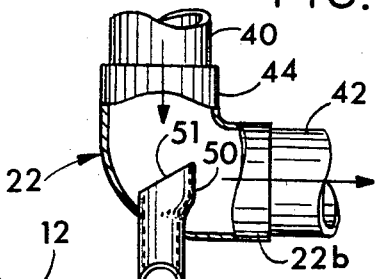
FIG. 5 is a partial horizontal sectional view taken on line 5—5 of FIG. 4.
Figure 4:
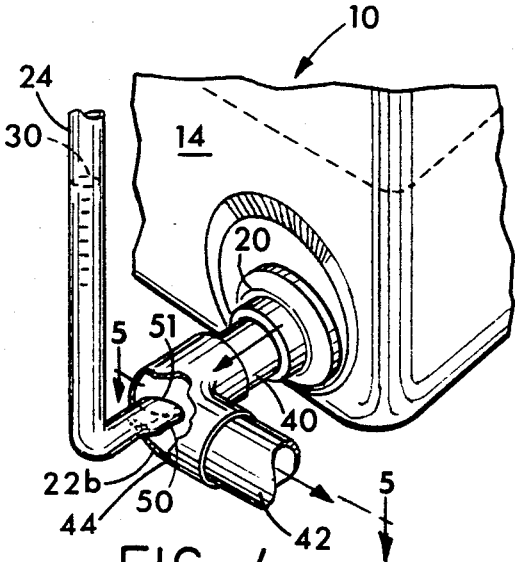
FIG. 4 is a perspective view of the suction line and air inlet duct in accordance with another embodiment of the invention.

Turn now to FIGS. 4 and 5 which illustrate another embodiment of the invention.

As shown in FIGS. 4 and 5 the water make-up pipe 32 is not used. However, the same numbers refer to corresponding parts in FIGS. 1–3. Instead of water make up pipe 32, the air inlet duct 24 is provided with a scoop 50 at its lower end which communicates with the interior of the water suction line 22*b*. It can be seen that the scoop 50 has an opening 51 facing upstream direction thereby gathering a portion of the water flowing through the pressure pipe 22*b* to maintain the water level 30 in the air inlet duct 24. The scoop 50 thus functions as a water make up means associated with air inlet duct 24 for forcing make-up water thereinto under pressure from the water circulation line 22. In operation under normal circumstances the rapid flow of water through the water circulation line 22 will be captured in part by the mouth of the scoop 50 which faces upstream preventing a draw down on the water column shown in the air inlet duct 24. However, when the water inlet 20 is obstructed, the reduced pressure in the suction line 22*b* will draw air into the air inlet duct 24 causing the water level 30 to drop allowing air to enter the system interferring with the operation of the pump and automatically reducing the pressure differential across the water inlet 20 as desired.

The size of various components should be adjusted to provide the best performance as will be apparent to those skilled in the art. For example if the pipe 32 is too large in diameter, too much water may be introduced into duct 24. Moreover, its effectiveness will depend upon the length of the pipe 32 and other factors such as how many bends there are in the water circulation line 22. In a typical situation with a pump P operated by a ¾ horsepower motor, a water make-up pipe 24 eighteen inches long will be effective if its I.D. is ¼ inch and the suction line 22*b* has an I.D. of 2 inches and the pressure line 22*a* has an I.D. of 1½ inches. The check valve 28 will function effectively to prevent water from flowing out on to the floor but allows air to enter as required.

Concerning the embodiment of FIG. 2 it should be explained that opening the valve V will allow more air to enter the stream ejected from the jet and this in turn will reduce the flow of water through the suction fitting 20 causing the water level to rise in air duct 24. However the level will not rise too high since the pressure will also be lower in pressure line 22*a* thereby automatically lowering the volume of water delivered through line 32 to the air duct and in this way providing dynamically balanced control. Thus the air control valves V together with the level of water in the tub 10 influence the water level in the air duct 24 so that an increase of say 12 inches in the water level of the tub will be compensated for by water entering through line 32 to provide a small increase of an inch or two in the level 30 in duct 24 thereby automatically maintaining the water level 30 in the pipe 24 in a dynamically balanced relatively constant state.

The scoop 50 in the FIGS. 4 and 5 is particularly effective if place where a 90 degree elbow is located in the suction line 22*b*. This is believed due to the greater pressure resulting from the centrifugal force which causes the water on the outside of the bend to travel faster thereby entering the scoop 50 with greater energy.

Many variations of the present invention within the scope of the appended claims will be apparent to those skilled in the art once the principles described therein are understood.

What is claimed is:

1. A dynamically balanced suction line relief for tubs, spas and pools comprising, a water circulation line having a water pump therein and including a suction line communicating between a water outlet in the tub and the pump and the water pressure line between the pump and a water inlet in the tub, an air inlet duct communicating with the suction line and extending upwardly therefrom and opening to the atmosphere at its upper end, said duct holding a column of water therein during normal operation while the tub is filled with water and the water outlet of the tub is unobstructed, a water make-up means operatively associated with the air inlet duct for forcing make-up water thereinto under pressure from the water circulation line to maintain the column of water therein until the outlet becomes obstructed whereupon the column of water is drawn down and air enters the suction line thereby causing the pump to cavitate relieving the suction.

2. The apparatus of claim 1 wherein the water make up means comprises a water pipe connection between the pressure line and the air inlet duct.

3. The apparatus of claim 2 wherein a metering orifice is provided in the water make-up pipe.

4. The apparatus of claim 1 wherein the water make up means comprises a scoop connected to the lower end of the air inlet duct and communicating between the air inlet duct and the interior of the water suction line and said scoop has a mouth facing in an upstream direction to receive a portion of the water flowing toward it to thereby maintain a column of water within the air inlet duct even when the pressure within the suction line is substantially below atmospheric pressure.

5. The apparatus of claim 1 wherein the water outlet comprises the hydrotherapy jet having an air inlet means, a valve communicates with the jet to control the flow of air thereto from the atmosphere and the water make up means associated with the air inlet duct maintains the water level therein in a state of dynamic balance in spite of the change of the flow rate through the hydrotherapy jet due to the opening and closing of the air control valve.

6. A dynamically balanced hydrotherapy system including a suction relief for preventing excessive suction comprising, a hydrotherapy drain-and-fill tub adapted to hold a quantity of water for hydrotherapy and bathing purposes, said tub having a water outlet and a hydrotherapy jet, water circulation line connected between the water outlet and the hydrotherapy jet, said water circulation line including a pump, said line including a suction line between the water outlet and the pump and a pressure line between the pump and the hydrotherapy jet, an air inlet duct connected to the water suction line and extending upwardly therefrom and being open to the atmosphere at its upper end to allow air to enter the air inlet duct from the atmosphere and flow into the suction line when the water outlet becomes obstructed, a normally open check valve at the upper end of the air inlet duct to prevent water from flowing out the top thereof while allowing air to enter the check valve, a water make-up means dynamically balancing the water pressure in the air inlet duct to maintain a column of water therein when the water outlet is unobstructed, said water make-up means being connected to the air inlet duct for introducing water under pressure thereinto from the water circulation line.

7. The apparatus of claim 6 wherein the water make-up means comprises a pipe connected between the water pressure line and the air inlet duct for supplying water to enter the air inlet duct.

8. The apparatus of claim 6 wherein the water make-up means comprises a scoop having an open mouth facing upstream at the end of the air inlet duct to maintain the level of water in the air inlet duct due to the ram effect of the water flowing through the suction line against the open mouth of the scoop.

* * * * *